US007453245B1

(12) United States Patent
Potanin et al.

(10) Patent No.: US 7,453,245 B1
(45) **Date of Patent: *Nov. 18, 2008**

(54) METHOD AND SYSTEM FOR PROVIDING PRECISE CURRENT REGULATION AND LIMITATION FOR A POWER SUPPLY

(75) Inventors: Vladislav Potanin, San Jose, CA (US); Elena Potanina, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/706,560

(22) Filed: Feb. 13, 2007

Related U.S. Application Data

(63) Continuation of application No. 11/100,826, filed on Apr. 7, 2005, now Pat. No. 7,176,664.

(51) Int. Cl.
*G05F 1/40* (2006.01)

(52) U.S. Cl. ..... 323/280; 323/281

(58) Field of Classification Search ..... 323/274, 323/280, 281, 282, 283, 284, 312
See application file for complete search history.

(56) References Cited

U.S. PATENT DOCUMENTS

| | | | | |
|---|---|---|---|---|
| 5,550,462 | A | 8/1996 | Nakajima | |
| 7,102,415 | B1 * | 9/2006 | Potanin et al. | 327/427 |
| 7,176,664 | B1 * | 2/2007 | Potanin et al. | 323/280 |

* cited by examiner

*Primary Examiner*—Adolf Berhane

(57) ABSTRACT

A method for providing precise current regulation and limitation for a power supply is provided. The method includes amplifying any difference between a load current signal and a current setting reference signal with a feedback loop amplifier to generate a feedback signal. A power output signal is generated based on the feedback signal. An output signal for the power supply is generated based on the power output signal. The load current signal and the current setting reference signal are generated based on the power output signal. An offset error signal is generated based on the load current signal and the current setting reference signal. A differential bias for the feedback loop amplifier is adjusted based on the offset error signal.

20 Claims, 2 Drawing Sheets

METHOD AND SYSTEM FOR PROVIDING PRECISE CURRENT REGULATION AND LIMITATION FOR A POWER SUPPLY

This application is a continuation of prior U.S. patent application Ser. No. 11/100,826 filed on Apr. 7, 2005 now U.S. Pat. No. 7,176,664.

TECHNICAL FIELD OF THE INVENTION

The present invention relates generally to power supplies and, more particularly, to a method and system for providing precise current regulation and limitation for a power supply.

BACKGROUND OF THE INVENTION

Business and consumers use a wide array of wireless devices, including cell phones, wireless local area network (LAN) cards, global positioning system (GPS) devices, electronic organizers equipped with wireless modems, and the like. The increased demand for wireless communication, and other mobile, devices has created a corresponding demand for technical improvements to such devices. Generally speaking, more and more of the components of conventional radio receivers and transmitters are being fabricated in a single integrated circuit package.

One important aspect of wireless devices having integrated circuits is battery performance. In order to provide optimal battery performance for these wireless devices, the power supplies generally have some form of current regulation and limitation on their operation. However, conventional current regulation and limitation techniques have several disadvantages.

For example, current limitation techniques typically have a slow current-limiting loop response. Because of this, a sudden load short may destroy the system. In addition, current regulation techniques typically fail to account for offset errors in loop amplifiers, resulting in poor accuracy. Finally, current techniques are generally implemented in low-density complementary bipolar systems, which wastes valuable area in the integrated circuit packages.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; "each" means every one of at least a subset of the identified items; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future, uses of such defined words and phrases.

BRIEF DESCRIPTION OF THE DRAWINGS

For a more complete understanding of the present invention and its advantages, reference is now made to the following description taken in conjunction with the accompanying drawings, wherein like reference numerals represent like parts, in which.

DETAILED DESCRIPTION OF THE INVENTION

Figure 1:
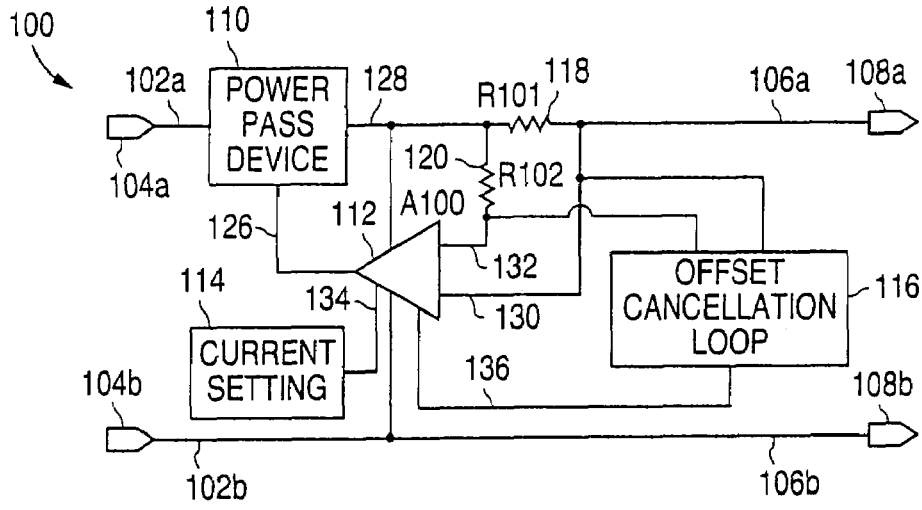
FIG. 1 is a block diagram illustrating a system for providing precise current regulation and limitation for a power supply in accordance with one embodiment of the present invention.
Figure 2:
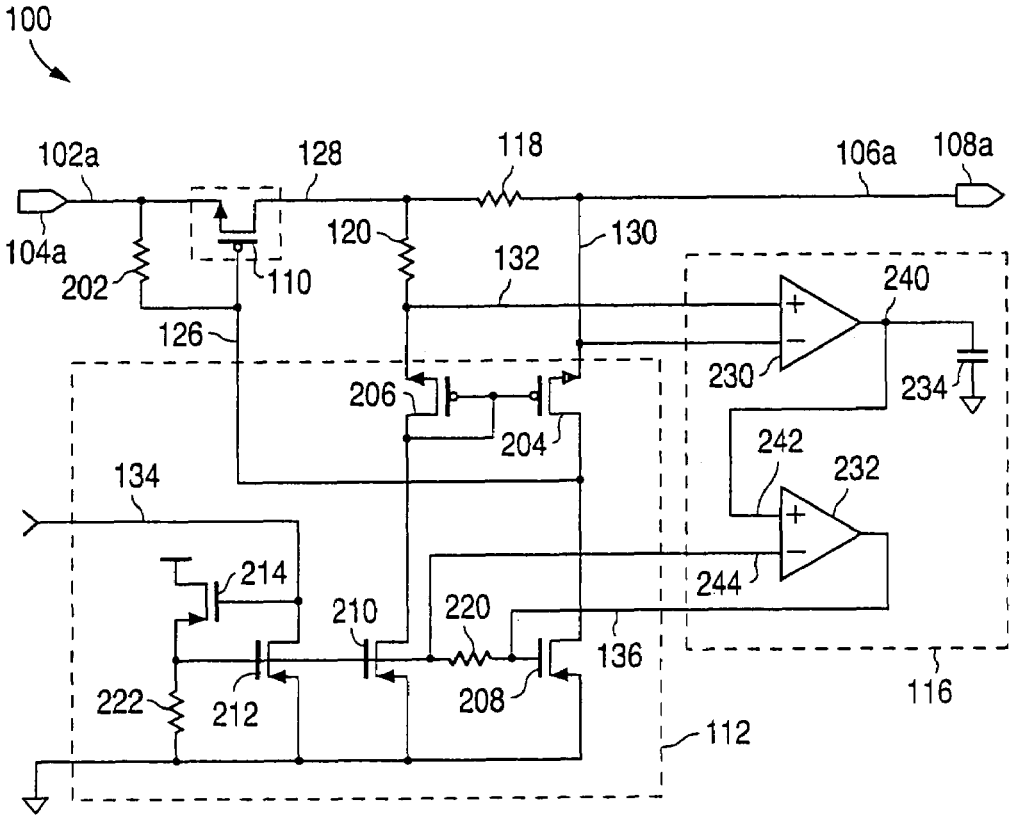
FIG. 2 is a circuit diagram illustrating the system of FIG. 1 in accordance with one embodiment of the present invention.
Figure 3:
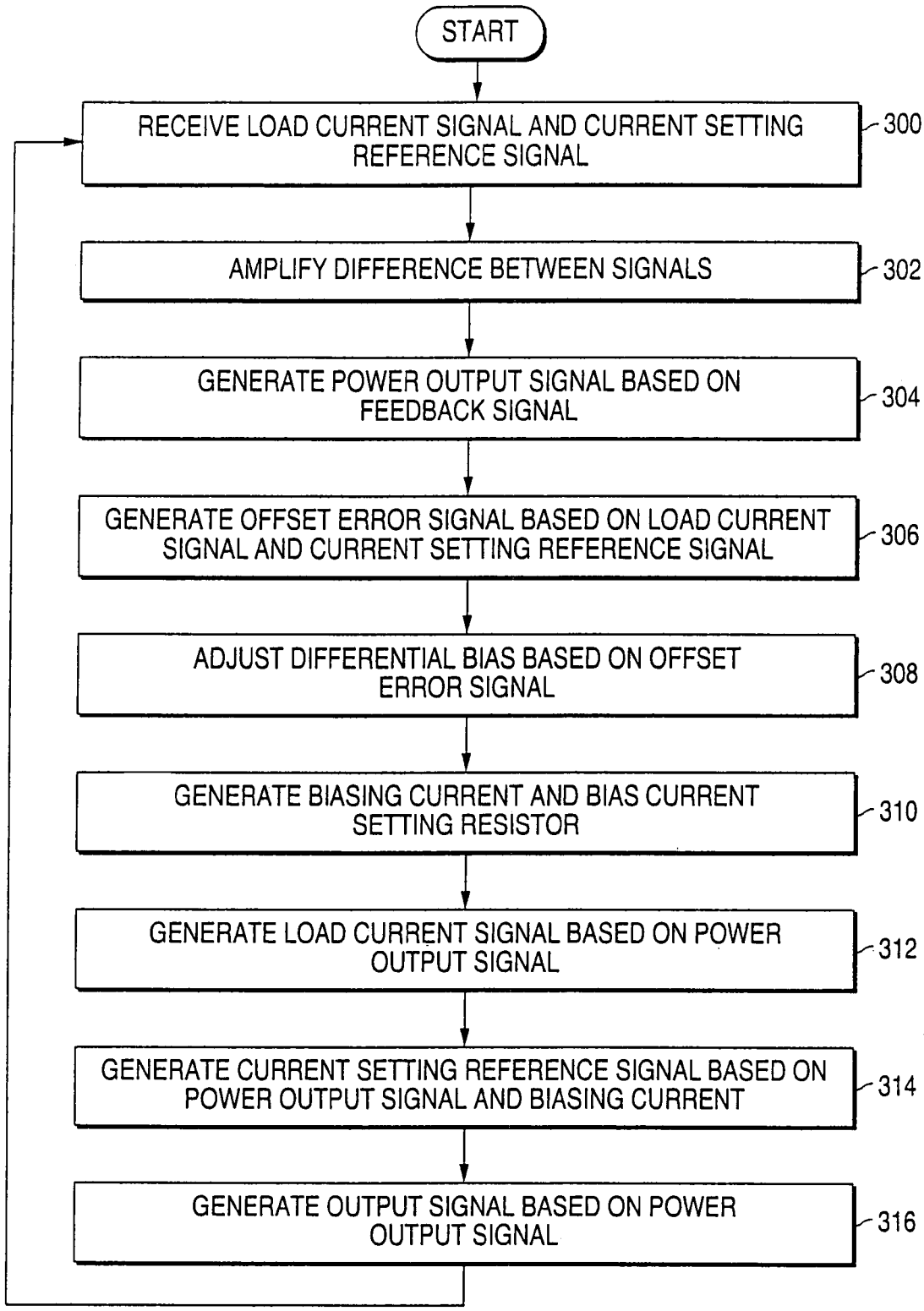
FIG. 3 is a flow diagram illustrating a method for providing precise current regulation and limitation for a power supply in accordance with one embodiment of the present invention.

FIGS. 1 through 3, discussed below, and the various embodiments used to describe the principles of the present invention in this patent document are by way of illustration only and should not be construed in any way to limit the scope of the invention. Those skilled in the art will understand that the principles of the present invention may be implemented in any type of suitably arranged power regulation system.

FIG. 1 is a block diagram illustrating a system 100 for providing precise current regulation and limitation for a power supply in accordance with one embodiment of the present invention. The system 100 is operable to receive an input signal 102*a-b* at input nodes 104*a-b* and to generate an output signal 106*a-b* based on the input signal 102*a-b* at output nodes 108*a-b*. The input signal 102 may be received from a power supply (not shown), such as a linear voltage or current regulator or other suitable power supply, and the output signal 106 may be provided to a load (not shown).

The system 100 comprises a power pass device 110, a feedback loop amplifier 112, a current setting block 114, an offset cancellation loop 116, a sense resistor 118, and a current setting resistor 120. The power pass device 110 is operable to control the amount of energy delivered by the system 100 to the load by controlling the output signal 106 generated at the output nodes 108. The power pass device 110 is operable to do this by making adjustments, based on a feedback signal 126, to a power output signal 128 that is generated by the power pass device 110 based on the input signal 102*a*. For one embodiment, the power pass device 110 may comprise a bipolar pnp transistor or a MOS transistor.

The feedback loop amplifier 112 is operable to amplify a difference between a load current signal 130 and a current setting reference signal 132 to generate the feedback signal 126. According to one embodiment, the feedback loop amplifier 112 is operable to provide a gain of about 500 with respect to the difference between the signals 130 and 132. However, it will be understood that the feedback loop amplifier 112 may provide any suitable gain without departing from the scope of the present invention.

The current setting block 114 is operable to generate a biasing current 134 for biasing the current setting resistor 120. The biasing current 134 may be fixed, determined by characteristics of an external component (not shown), programmable by digital code, or otherwise suitably determined.

The offset cancellation loop 116 is operable to generate an offset error signal 136 for adjusting the differential biasing of the feedback loop amplifier 112. For one embodiment, the offset cancellation loop 116 may comprise a high-gain, slow-response, low-offset amplifier.

In accordance with a particular embodiment, the sense resistor 118 may comprise a resistance of about 100 mΩ, and the current setting resistor 120 may comprise a resistance of about 1 kΩ. However, it will be understood that the resistances provided by the resistors 118 and 120 may comprise any suitable values without departing from the scope of the present invention.

In operation, according to a particular embodiment, the power pass device 110 may change its conductivity based on the feedback signal 126 generated by the feedback loop amplifier 112. This changes the power output signal 128 generated by the power pass device 110. The voltage of the power output signal 128 drops across the sense resistor 118, which generates the load current signal 130. The voltage of the power output signal 128 also drops across the current setting resistor 120, which generates the current setting reference signal 132.

The load current signal 130 and the current setting reference signal 132 are provided to the feedback loop amplifier 112 and to the offset cancellation loop 116. The feedback loop amplifier 112 amplifies any difference between the load current signal 130 and the current setting reference signal 132 to generate the feedback signal 126. In addition, the offset cancellation loop 116 generates the offset error signal 136 based on the load current signal 130 and the current setting reference signal 132. The offset cancellation loop 116 provides the offset error signal 136 to the feedback loop amplifier 112 to increase the accuracy of the feedback loop amplifier 112.

The current setting block 114 generates the biasing current 134 for biasing the current setting resistor 120 and provides the biasing current 134 to the feedback loop amplifier 112. Finally, the load current signal 130 is also provided to the output node 108*a* and the input signal 102*b* is provided to the output node 108*b*, resulting in the generation of the output signal 106*a-b* for the load.

With a high enough gain for the feedback loop amplifier 112, the system 100 reaches equilibrium when the current setting reference signal 132 is equal to the output voltage 106*a*, which is the equivalent of the load current signal 130. If the drop across the sense resistor 118 is high, the load current signal 130 is lower compared to the current setting reference signal 132. In this situation, the current generated by the power pass device 110 decreases, resulting in a decrease in the drop across the sense resistor 118. In this way, the signals 130 and 132 are brought closer together. Similarly, if the drop across the sense resistor 118 is low, the power pass device 110 generates more current in order to increase the drop across the sense resistor 118.

Thus, the system 100 is operable to provide current regulation and limitation for a power supply using offset cancellation for a feedback loop amplifier 112. This system 100 has a lower gain than a differential pair implementation and also operates more quickly.

FIG. 2 is a circuit diagram illustrating the system 100 in accordance with one embodiment of the present invention. For this embodiment, the power pass device 110 comprises a PMOS transistor. A resistor 202 is coupled to the gate and the source of the PMOS transistor 110.

Also for this embodiment, the feedback loop amplifier 112 comprises two PMOS transistors 204 and 206, four NMOS transistors 208, 210, 212 and 214, and two resistors 220 and 222, and the offset cancellation loop 116 comprises two amplifiers 230 and 232 and a capacitor 234. The input of the feedback loop amplifier 112 and the input of the offset cancellation loop 116 are coupled to the current sense resistor 118 and current setting resistor 120. The intermediate node and the output of the offset cancellation loop 116 are coupled to the feedback loop amplifier 112 on either side of the resistor 220.

For one embodiment, the system 100 may also comprise an enable circuit (not shown) that is operable to enable and disable the system 100 based on an enable signal. The enable signal may be generated by a microcontroller or other suitable external component.

In operation, for one embodiment, the feedback loop amplifier 112 receives the load current signal 130 at the PMOS transistor 204, the current setting reference signal 132 at the PMOS transistor 206, the biasing current 134 at the NMOS transistors 214 and 212, and the offset error signal 136 at the NMOS transistor 208. The biasing current 134 is mirrored to NMOS transistor 210. The drain current of NMOS transistor 210 generates a voltage drop across PMOS transistor 206 and the current setting resistor 120.

PMOS transistor 204 operates in a common gate operation mode. Thus, PMOS transistor 204 senses the voltage of the load current signal 130 and, if the sensed voltage is higher than the voltage of the current setting reference signal 132, PMOS transistor 204 drives the voltage of the feedback signal 126 higher. Alternatively, if the sensed voltage is lower than the voltage of the current setting reference signal 132, PMOS transistor 204 reduces its conductivity and NMOS transistor 208 sinks current, thereby driving the voltage of the feedback signal 126 lower. NMOS transistor 208 is coupled to the common gate node of the current mirror formed by NMOS transistors 212 and 214 through resistor 220, which is used to adjust the offset of the feedback loop amplifier 112.

Amplifier 230 senses voltages for the load current signal 130 and the current setting reference signal 132 and converts any voltage difference between the signals 130 and 132 into an output current 240 that is provided to the capacitor 234. Amplifier 230 uses a chopping technique to minimize its own offset.

The capacitor 234 acts as an integration capacitor, providing an integrated voltage for a first input 242 to amplifier 232. A second input 242 to amplifier 232 is provided by the current mirror of the feedback loop amplifier 112. Amplifier 232 converts any voltage difference between the inputs 242 and 244 into a current in the form of the offset error signal 136. Amplifier 232 then supplies the offset error signal 136 to the resistor 220 and to the gate of NMOS transistor 208, thereby adjusting the amount of current sunk by NMOS transistor 208.

In accordance with a particular embodiment, the sense resistor 118 may comprise a resistance of about 100 mΩ, and the current setting resistor 120 may comprise a resistance of about 1 kΩ. In addition, the resistor 202 may comprise a resistance of about 200%, the resistor 220 may comprise a resistance of about 20 kΩ, and the resistor 222 may comprise a resistance of about 4 kΩ. Also, amplifier 230 may provide a gain of about 1000, and amplifier 232 may provide a gain of about 1000. Finally, the capacitor 234 may provide a capacitance of about 20 pF. However, it will be understood that the resistances provided by the resistors 118, 120, 202, 220 and 222, the capacitance provided by the capacitor 234, and the gains provided by the amplifiers 230 and 232 may comprise any suitable values without departing from the scope of the present invention.

FIG. 3 is a flow diagram illustrating a method for providing precise current regulation and limitation for a power supply in accordance with one embodiment of the present invention. The method begins at step 300 where the feedback loop amplifier 112 receives the load current signal 130 and the current setting reference signal 132 from the sense resistor 118 and the current setting resistor 120, respectively. At step 302, the feedback loop amplifier 112 amplifies any difference between the signals 130 and 132 to generate a feedback signal 126. According to one embodiment, the feedback loop amplifier 112 amplifies any difference between the signals 130 and 132 with a gain of about 500.

At step 304, a power pass device 110 generates a power output signal 128 based on the feedback signal 126. For one embodiment, the power pass device 110 comprises a MOS transistor that is operable to change its conductivity based on the feedback signal 126, thereby changing the power output signal 128 generated by the power pass device 110.

At step 306, the offset cancellation loop 116 generates an offset error signal 136 based on the load current signal 130 and the current setting reference signal 132. At step 308, the offset cancellation loop 116 adjusts a differential bias for the feedback loop amplifier 112 based on the offset error signal 136. At step 310, the current setting block 114 generates a biasing current 134 and biases the current setting resistor 120 based on the biasing current 134.

At step 312, the sense resistor 118 generates the load current signal 130 based on the power output signal 128. For one embodiment, the sense resistor 118 comprises a resistance of about 100 mΩ. At step 314, the current setting resistor 120 generates the current setting reference signal 132 based on the power output signal 128 and the biasing current 134. For one embodiment, the current setting resistor 120 comprises a resistance of about 1 kΩ.

At step 316, the system 100 generates an output signal 106 for the load, such as a power supply, based on the power output signal 128. For one embodiment, the output signal 106*a* is equivalent to the load current signal 130, and the output signal 106*b* is equivalent to the input signal 102*b*. At this point, the method returns to step 300 where the feedback loop amplifier 112 continues to receive the load current signal 130 and the current setting reference signal 132.

In this way, the feedback loop amplifier 112 is able to adjust the power pass device 110 such that any difference between the load current signal 130 and the current setting reference signal 132 is reduced. Using the offset cancellation loop 116 to adjust the differential bias of the feedback loop amplifier 112 allows the feedback loop amplifier 112 to function more precisely. Thus, the system 100 provides a relatively fast time response for current limiting purposes and high accuracy for operating in a current regulation mode. In addition, the tracking biasing technique provided by the offset cancellation loop 116 allows adjustment of the feedback frequency response in accordance with a preset current limit level, thereby ensuring system stability.

Although the present invention has been described with several embodiments, various changes and modifications may be suggested to one skilled in the art. It is intended that the present invention encompass such changes and modifications as fall within the scope of the appended claims.

What is claimed is:

1. A method comprising:

generating a power output signal, the power output signal associated with a load current signal;

generating a feedback signal and an offset cancellation signal based on the load current signal and a reference signal;

adjusting the power output signal based on the feedback signal; and adjusting the feedback signal based on the offset cancellation signal.

2. The method of claim 1, wherein:

generating the power output signal comprises generating the power output signal using a pass device; and adjusting the power output signal comprises adjusting a conductivity of the pass device based on the feedback signal.

3. The method of claim 1, wherein generating the feedback signal comprises amplifying a difference between the load current signal and the reference signal using an amplifier.

4. The method of claim 3, wherein adjusting the feedback signal comprises adjusting a differential bias of the amplifier based on the offset cancellation signal.

5. The method of claim 1, further comprising:

generating the load current signal using a first resistor; and generating the reference signal using a second resistor.

6. The method of claim 5, further comprising:

generating a biasing current; and biasing the second resistor based on the biasing current.

7. An apparatus comprising:

a pass device configured to receive an input signal and generate a power output signal based on the input signal, the power output signal associated with a load current signal;

an amplifier configured to generate a feedback signal based on the load current signal and a reference signal, wherein the pass device is configured to be adjusted based on the feedback signal; and an offset cancellation loop configured to generate an offset cancellation signal based on the load current signal and the reference signal, wherein the amplifier is configured to be adjusted based on the offset cancellation signal.

8. The apparatus of claim 7, further comprising:

a first resistor coupled between the pass device and the amplifier and configured to generate the load current signal; and a second resistor coupled between the pass device and the amplifier and configured to generate the reference signal.

9. The apparatus of claim 8, further comprising:

a current setting block configured to generate a biasing current and to bias the second resistor based on the biasing current.

10. The apparatus of claim 7, wherein a conductivity of the pass device is adjusted based on the feedback signal.

11. The apparatus of claim 7, wherein a differential bias of the amplifier is adjusted based on the offset cancellation signal.

12. The apparatus of claim 7, wherein:

the amplifier comprises a first amplifier; and the offset cancellation loop comprises:

a second amplifier configured to receive the load current signal and the reference signal and to generate an output current;

a capacitor configured to generate an integration voltage based on the output current; and a third amplifier configured to receive the integration voltage and a voltage from the first amplifier and to generate the offset cancellation signal.

13. The apparatus of claim 12, wherein:

the first amplifier comprises a current mirror; and the voltage from the first amplifier is provided by the current mirror.

14. A system comprising:

a power supply configured to provide an input signal;

a pass device configured to receive the input signal and generate a power output signal based on the input signal, the power output signal associated with a load current signal;

an amplifier configured to generate a feedback signal based on the load current signal and a reference signal, wherein the pass device is configured to be adjusted based on the feedback signal; and an offset cancellation loop configured to generate an offset cancellation signal based on the load current signal and the reference signal, wherein the amplifier is configured to be adjusted based on the offset cancellation signal.

15. The system of claim 14, further comprising:

a first resistor coupled between the pass device and the amplifier and configured to generate the load current signal;

a second resistor coupled between the pass device and the amplifier and configured to generate the reference signal; and a current setting block configured to generate a biasing current and to bias the second resistor based on the biasing current.

16. The system of claim 14, wherein a conductivity of the pass device is adjusted based on the feedback signal.

17. The system of claim 14, wherein a differential bias of the amplifier is adjusted based on the offset cancellation signal.

18. The system of claim 14, wherein:

the amplifier comprises a first amplifier; and the offset cancellation loop comprises:

a second amplifier configured to receive the load current signal and the reference signal and to generate an output current;

a capacitor configured to generate an integration voltage based on the output current; and a third amplifier configured to receive the integration voltage and a voltage from the first amplifier and to generate the offset cancellation signal.

19. The system of claim 18, wherein:

the first amplifier comprises a current mirror; and the voltage from the first amplifier is provided by the current mirror.

20. The system of claim 14, wherein the power supply comprises a linear voltage or current regulator.

* * * * *